US010152909B2

(12) United States Patent
Matsumoto

(10) Patent No.: US 10,152,909 B2
(45) Date of Patent: Dec. 11, 2018

(54) DISPLAY APPARATUS

(71) Applicant: NICHIA CORPORATION, Anan-shi (JP)

(72) Inventor: Makoto Matsumoto, Tokushima (JP)

(73) Assignee: NICHIA CORPORATION, Anan-shi (JP)

( * ) Notice: Subject to any disclaimer, the term of this patent is extended or adjusted under 35 U.S.C. 154(b) by 0 days.

(21) Appl. No.: 15/835,461

(22) Filed: Dec. 8, 2017

(65) Prior Publication Data

US 2018/0174502 A1 Jun. 21, 2018

(30) Foreign Application Priority Data

Dec. 21, 2016 (JP) ..... 2016-247763

(51) Int. Cl.
*G09G 3/20* (2006.01)
*G09G 3/32* (2016.01)
*G09G 3/3216* (2016.01)

(52) U.S. Cl.
CPC ..... *G09G 3/2022* (2013.01); *G09G 3/2018* (2013.01); *G09G 3/2025* (2013.01); *G09G 3/32* (2013.01); *G09G 3/3216* (2013.01); *G09G 2300/0426* (2013.01); *G09G 2310/0248* (2013.01); *G09G 2320/02* (2013.01); *G09G 2320/0233* (2013.01); *G09G 2320/0238* (2013.01)

(58) Field of Classification Search
CPC ... G09G 3/2018; G09G 3/2025; G09G 3/2022
See application file for complete search history.

(56) References Cited

U.S. PATENT DOCUMENTS

2004/0239696 A1 12/2004 Okabe et al.
2016/0365033 A1* 12/2016 Song ..... G09G 3/3258

FOREIGN PATENT DOCUMENTS

JP 2005-010741 1/2005

* cited by examiner

*Primary Examiner* — Dennis P Joseph
(74) *Attorney, Agent, or Firm* — Mori & Ward, LLP

(57) ABSTRACT

In a display apparatus having a plurality of light emitting elements, a single frame includes a plurality of sub-frames, each of which includes a plurality of weighted elements with different gradations expressed at powers of two. When the number of sub-frames in a single frame is X (X is an integer greater than 1) and a maximum gradation value that can be expressed in each of the sub-frames is $2^Y-1$ (Y is an integer greater than 1), and the single frame is expressed by the gradation value in a range of $X \cdot 2^{Y-1}$ to $X(2^Y-1)-2^{Y-1}$, a lighting controller allocates the gradation value to each of the sub-frames so that the weighted element at an end of a timeline of at least one sub-frame of the plurality of sub-frames in the single frame is turned OFF.

12 Claims, 6 Drawing Sheets

DISPLAY APPARATUS

CROSS-REFERENCE TO RELATED PATENT APPLICATION

The present application claims priority under 35 U. S. C. § 119 to Japanese Patent Application No. 2016-247763, filed Dec. 21, 2016. The contents of this application are incorporated herein by reference in their entirety.

BACKGROUND OF THE INVENTION

1. Field of the Invention

The present disclosure relates to a display apparatus having a plurality of light emitting elements arranged in rows and columns.

2. Discussion of the Background

Nowadays, a display unit using light emitting diodes (LEDs) as light emitting elements and a display apparatus using the display unit are manufactured. For example, a large-screen display apparatus can be made by combining a plurality of display units. In a display unit including LEDs arranged in a dot matrix array of m rows and n columns, for example, anode terminals of LEDs located at each row are electrically connected to a single common line and cathode terminals of LEDs located at each column are electrically connected to a single drive line. The common lines of m-rows are successively turned ON with a predetermined cycle and the LEDs arranged on the turned ON common lines are individually driven by the drive lines.

In a known method, gradation control of such a display apparatus is operated through turning on and off a plurality of light emitting elements by weighting lighting periods to power of two such as 1:2:4:8 (for example, see Japanese Unexamined Patent Application Publication No. 2005-010741). Such a control method may be referred to as "weighting control."

However, in a conventional weighting control, positions to be lit are determined based on weighting arrangement, so that when the last weighted element in a timeline is turned on, significant pseudo lighting may be caused. Pseudo lighting may also be called erroneous lighting, false lighting, feeble lighting, or the like, and is typically referred to as unintended lighting caused by accumulated electric charges in a parasitic capacitance of a wiring.

There is a need to provide a display apparatus in which erroneous lighting of light emitting elements is reduced and display quality is improved.

SUMMARY

A display apparatus includes a plurality of common lines, a plurality of drive lines, a plurality of light emitting elements respectively electrically connected to one of the plurality of common lines and one of the plurality of drive lines, a scanner to time-divisionally apply a voltage on the plurality of common lines, a driver to draw electric current at a predetermined timing from drive lines, of the plurality of drive lines, electrically connected to respective light emitting elements, of the plurality of light emitting elements, to turn ON the respective light emitting elements, and a lighting controller to vary lighting periods of the plurality of light emitting elements to express lighting amounts as different gradation values. A single frame is divided into a plurality of sub-frames and a gradation value to express in the single frame is divided into gradation values and allocated to the plurality of sub-frames, the gradation values allocated to the sub-frames are time-divisionally expressed so that the gradation value of the single frame is expressed by a total of the gradation values of the sub-frames. Each of the plurality of sub-frames includes a plurality of weighted elements with different gradation values to express the gradation values by powers of two, and a weighted element at an end of a timeline of a single sub-frame is assigned with a maximum gradation value. When the single frame includes X sub-frames (where X is an integer greater than 1), a maximum gradation value that can be expressed by each of the sub-frames is $2^Y-1$ (where Y is an integer greater than 1), and when the single frame is to express a gradation value in a range of $X\ 2^{Y-1}$ to $X(2^Y-1)-2^{Y-1}$, the lighting controller allocates the gradation value to each of the sub-frames so that the weighted element at the end of the timeline of at least one sub-frame of the plurality of sub-frames in the single frame is turned OFF.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
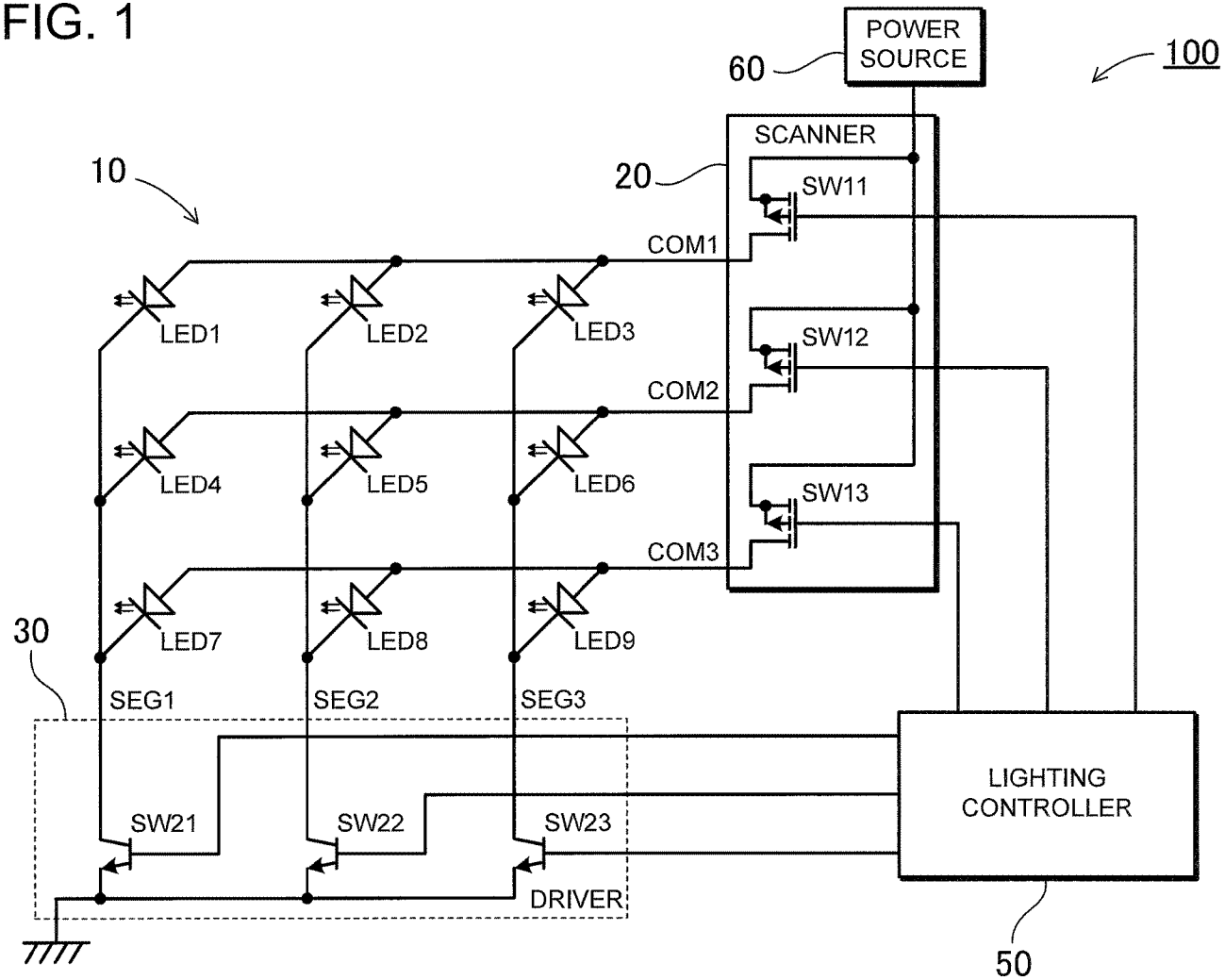
FIG. 1 is a circuit diagram of a display apparatus according to a first embodiment of the present disclosure.

The embodiments according to the present invention will be described below with reference to the drawings. The embodiments shown below are intended as illustrative to give a concrete form to technical ideas of the present invention, and the scope of the invention is not limited to those described below. Further, the members shown in claims attached hereto are not specifically limited to members in the embodiments. The sizes, materials, shapes and the relative configuration etc. of members described in embodiments are given as an example and not as a limitation to the scope of the invention unless specifically described otherwise. The sizes and the arrangement relationships of the members in each of drawings are occasionally shown exaggerated for ease of explanation. In the description below, the same designations or the same reference numerals denote the same or like members and duplicative descriptions will be appropriately omitted. In addition, a plurality of structural elements of the present invention may be configured as a single part which serves the purpose of a plurality of elements, on the other hand, a single structural element may be configured as a plurality of parts which serve the purpose of a single element. Description given in one example and one embodiment can also be applied in other examples and embodiments.

In the present specification, the term "parasitic capacitance" mainly refers to a parasitic capacitance in drive lines. Parasitic capacitance may exist between parts of electronic components, for example, caused by an electronic component having a capacitance connected to a drive line.

First Embodiment

FIG. 1 is a circuit diagram of a display apparatus according to a first embodiment. As shown in FIG. 1, a display apparatus 100 includes a display 10, a scanner 20, a driver 30, and a lighting controller 50. The display 10 includes a plurality of common lines COM1 to COM3, a plurality of drive lines SEG1 to SEG3, and a plurality of light emitting elements 10.

The plurality of light emitting elements are electrically connected to a plurality of common lines and a plurality of drive lines. In the present embodiment, light emitting diodes (LEDs) are used as the light emitting elements. The plurality of light emitting elements are arranged in rows and columns and respectively electrically connected to one of the plurality of common lines and one of the plurality of drive lines to form the display 10.

The scanner 20 time-divisionally applies voltage to the plurality of common lines and includes one or more source drivers. Further, an electric power source 60 is electrically connected to the scanner 20 to supply electric power to driver elements such as transistor that form the scanner 20. In the example shown in FIG. 1, a common anode configuration in which anode-sides of the plurality of light emitting elements are electrically connected to the power source side if adapted.

The driver 30 draws electric current at predetermined timings from the drive lines electrically connected to the light emitting elements to light, and includes one or more sink drivers.

Figure 8:
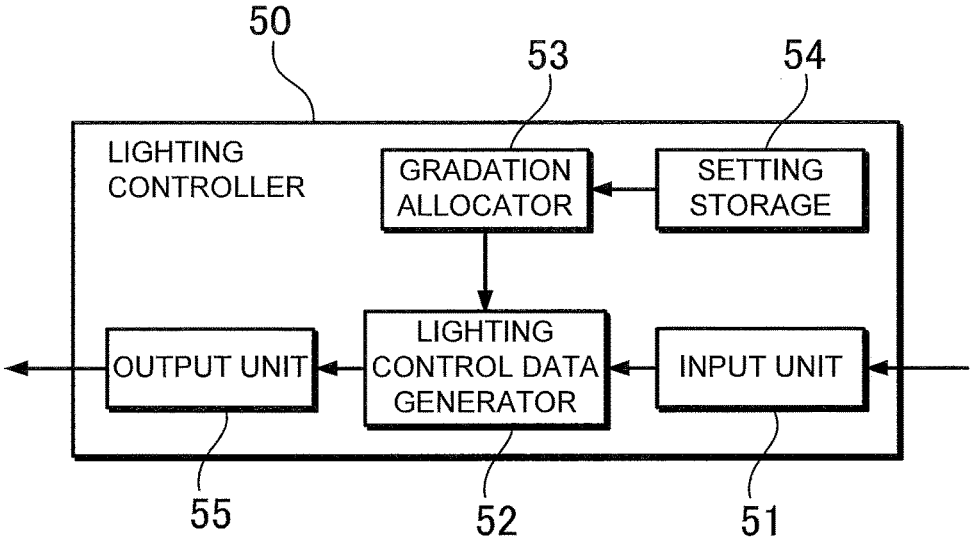
FIG. 8 is a functional block diagram illustrating an example of lighting controller.
Figure 9:
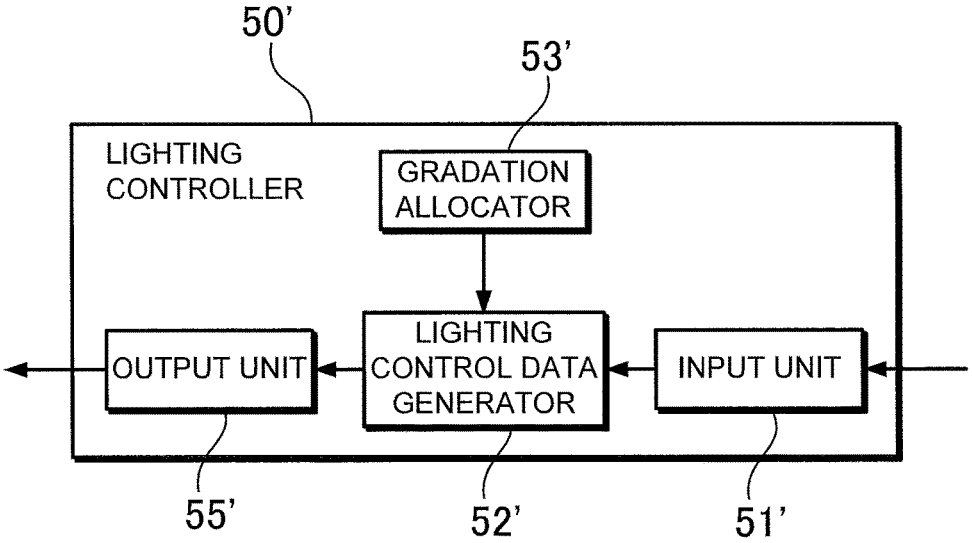
FIG. 9 is a functional block diagram illustrating another example of lighting controller.

The lighting controller 50 controls those operations of the scanner 20 and the driver 30. An example of functional block diagram of the lighting controller 50 is illustrated in FIG. 8. The lighting controller 50 shown in FIG. 8 includes an input unit 51, a lighting control data generator 52, a gradation allocator 53, a setting storage 54, and an output unit 55. Such a lighting controller 50 can be realized by hardware such as predetermined gate arrays (such as FPGA and ASIC) or the like, and software, or combination of those. The configuration of those components is not necessarily the same as those illustrated in FIG. 8 and FIG. 9 that will be described below, and those having functions substantially the same or a component having function of plurality of components shown in FIG. 8 and/or FIG. 9 will also be included in the present invention.

The input unit 51 receives data to be displayed from an external display source, for example. The lighting control data generator 52 generates lighting control data according to the display data that is received, to drive the scanner 20 and the driver 30. The gradation allocator 53 allocates gradations to the sub-frames, as described below, to express gradations. The lighting control data generator 52 produces lighting control data by allocating gradations determined by the gradation allocator 53 to the sub-frames. The setting storage 54 stores setting data such as number of gradations to allocate to the sub-frames by the gradation allocator 53. The setting storage 54 may use a storage medium and a non-volatile memory. The output circuit 55 operates the scanner 20 and the driver 30 to activate corresponding light emitting elements according to the lighting control data generated by the lighting control data generator 52. One image expressed on the display 10 is expressed by one cycle a combination of a plurality of single frames each obtained by a single scan the scanner 20 scanned the common lines.

In order to express a multi-gradation color image, a single frame is divided into a plurality of sub-frames, gradation to be expressed in a single frame is divided and allocated through the sub-frames so that gradation allocated to each of the sub-frames is expressed in a time-sharing manner in operation. The allocation is provided by the gradation allocator 53. Thus, the gradation of a single frame is expressed with entire gradations of the sub-frames that form a single frame.

Each of the plurality of sub-frames is divided into a plurality of weighted elements each exhibiting different gradation based on powers of two. Further, the weighted element at the end of a timeline in each single sub-frame is designated to exhibit a greatest gradation. When the number of sub-frames in a single frame is X (X is an integer greater than 1) and a greatest gradation value that can be exhibited in each of the sub-frames is $2^{Y-1}$ (Y is an integer greater than 1), and the gradation value expressed in a single frame is between $X \cdot 2^{Y-1}$ and $X(2^{Y}-1)-2^{Y-1}$, the lighting controller 50 allocates gradation values to the sub-frames so that in at least one sub-frame in the single frame, the weighted element at the end of the timeline of the single sub-frames is set to turn OFF its corresponding light emitting element.

Such a control of the gradation allocation in a gradation range described above is exercised because when the gradation value that is expressed in a single frame is smaller than $X \cdot 2^{Y-1}$, the weighted element at the end of the timeline in a single sub-frame is OFF, which reduces pseudo lighting. Meanwhile, when the gradation value that is expressed in a single frame is greater than $X(2^{Y}-1)-2^{Y-1}$, the weighted element at the end of the timeline in each of the plurality of single sub-frames in a single frame is needed to be ON, so that the weighted element at the end of the timeline in a single sub-frame is not allowed to turn OFF.

In the first embodiment, when each of the sub-frames can express gradations of Y bits that is $2^{Y}$, a gradation value less than $2^{Y-1}$ is allocated to at least one sub-frame. For example, when each of the sub-frames can express a maximum gradation value of 32, at least one sub-frame is allocated to a gradation value of less than 16. In order to allocate gradations in one frame so that the last weighted element that is located at an end of timeline of at least one sub-frame is turned OFF, allocation of 16 or greater gradation values to all the sub-frames has to be avoided. This is because if all the sub-frames in a single frame are allocated to 16 or greater gradation values, the last weighted element with a gradation value of 16 is inevitably turned ON.

Gradation values are preferably allocated to the sub-frames respectively to increase the number of sub-frames to turn OFF the light emitting elements corresponding to the last weighted elements in the timelines in the weighting alignment in each of the sub-frames. For example, the lighting controller 50 operates so that, in at least half among the plurality of sub-frames in a single frame, the light emitting elements corresponding to the last weighted element in the timeline in a single sub-frame are turned OFF. Accordingly, pseudo lighting can be efficiently decreased.

It is more preferable that the lighting controller 50 allocates gradation values to the sub-frames so that a difference between the maximum value and the minimum value of gradation in each of the sub-frames to be two or greater. With this, allocation of gradation within the sub-frame can differ among the sub-frames that can facilitate to turn OFF the light emitting elements corresponding to the last weighted elements in the timeline in the sub-frames.

Further, difference in gradation value between adjacent two sub-frames of the plurality of sub-frames in a single frame is preferably $2^{Y-1}+1$. Accordingly, lighting control can be simplified. For example, monitoring two high-order bits in the gradation expressed in a single frame and when the two high-order bits are 10 (binary digits), gradation value of $2^{Y-2}$ may be added to one single sub-frame and gradation value of $2^{Y-2}$ may be subtracted from the other single sub-frame.

In addition, when the lighting controller 50 aligns the plurality of sub-frames, the weighted elements in each sub-frame are preferably aligned to increase the gradation values along the timeline. That is, the weighted elements of power of two in each sub-frame are aligned in ascending order.

When the lighting controller 50 aligns the plurality of sub-frames, the weighted element at the end in timeline of each of the sub-frames is allocated to the period of turning corresponding light emitting elements OFF, if the duration of the OFF period is short, an effect of pseudo lighting reduction may become difficult to exert. In order to efficiently exert such a pseudo lighting reduction effect, a single sub-frame necessarily includes an OFF period with a certain length. In the first embodiment, the weighted element at the end in the timeline of a single sub-frame has a maximum gradation value and the gradation value is allocated so that the weighted element of the maximum gradation value is to be turned OFF. Thus, the effect of pseudo lighting reduction can be efficiently exerted. Note that, if the light emitting elements corresponding to all weighted elements in a single sub-frame are to be turned off, the effect of pseudo lighting reduction may be exerted efficiently, however, generation of flickering may become of concern.

In the display apparatus 100 according to the first embodiment, gradation value is allocated to the sub-frames to reduce the number of light emitting elements turned on at the end in timeline in weighted alignment. That is, in a single frame, the sub-frames are allocated to gradation values so that the end weighted element in a timeline in a single sub-frame is OFF in at least one sub-frame in a single frame. Thus, reducing the number of lighting at the ends in timelines of a single sub-frame allows to provide a charging time for a parasitic capacitance between the drive line and the GND, through the light emitting element that is subjected to lighting. This can reduce the charging amount for the parasitic capacitance between the drive line and the GND, through the light emitting elements that are not subjected to lighting.

Example of Operation

Next, operation of a display apparatus 100 shown in FIG. 1 will be described below. In the example shown in FIG. 1, the display apparatus 100 includes a plurality of LEDs 1 to 9, three common lines COMs 1 to 3 each electrically connected to first ends of the plurality of LEDs 1 to 3, a power supply 60 to supply voltage to the plurality of LEDs 1 to 9, a plurality of drive lines SEGs 1 to 3 electrically connected to second ends of the plurality of LEDs 1 to 9, and a lighting controller 50 to control lighting of the plurality of LEDs 1 to 9. In the display device 100, when a gradation lighting control is performed, an electric current is drawn in a time divisional manner from the drive line electrically connected to the LEDs that are subjected to lighting.

LEDs 1 to 9

As the plurality of light emitting elements, for example the plurality of LEDs 1 to 9 shown in FIG. 1 can be employed.

Common Lines COM1 to COM3

The common lines COM1 to COM3 are electrically connected to one ends of the plurality of LEDs 1 to 9. The plurality of LEDs 1 to 9 are connected to the common lines COM1 to COM3 in a common anode configuration as shown in FIG. 1. For the common lines COM1 to COM3, a copper foil or the like can be used (e.g., part of the interconnection of the printed circuit board). In the printed circuit board or the like, the common lines COM1 to COM3 can be formed into various shapes such as a linear shape or planar shape (a rectangular shape, a circular shape, or the like). The expression "line" is not intended to limit the actual shape of the common lines COM1 to COM3 formed on the printed circuit board or the like to a linear shape. Instead, the expression is used just because the common lines COM1 to COM3 can be represented by lines when they are schematically shown in a circuit diagram. Each of the common lines COM1 to COM3 may be split (branched) in midway. Note that, although three common lines are employed in the first embodiment, at least one common line will be sufficient.

Power Supply 60

The power supply 60 applies voltage to the plurality of LEDs 1 to 9. The power source 60 applies voltages in a time-sharing manner to each common line (dynamic control). For the power supply 60, for example, a DC constant voltage source of a series system or a switching system can be employed.

Source Drivers SW11 to SW13

The source drivers SW11 to SW13 of the scanner 20 are switches for connecting the common lines COM1 to COM 3 and are time-divisionally turned ON or OFF by the lighting controller 50. For the source drivers SW11 to SW13, a P-channel field effect transistor (FET) or a PNP transistor can be used.

Drive Lines SEG1 to SEG3

The plurality of drive lines SEG1 to SEG3 are connected to other ends of the plurality of LEDs 1 to 9. For the drive lines SEG1 to SEG3, a copper foil or the like (e.g., part of the interconnection of the printed circuit board) may be employed.

Sink Drivers SW1 to SW23

Sink drivers SW21 to SW23 of the driver 30 are connected to a plurality of drive lines SEG1 to SEG3 and serve as switches connecting the drive lines SEG1 to SEG3 and GND, and are turned ON or OFF by the lighting controller 50. For the sink drivers SW21 to SW23, an NPN transistor or an N-channel field effect transistor (FET) can be used. The electric current flowing to the drive lines SEG1 to SEG3 can be controlled with a resistor and/or by a constant current source, or the like, which may be disposed between the sink drivers SW21 to SW23 and the GND, or between the sink drivers SW21 to SW23 and drive lines SEG1 to SEG3.

Lighting Controller 50

The lighting controller 50 controls ON or OFF of the source drivers SW11 to SW13 and the sink drivers SW21 to SW23, to control lighting of the plurality of LEDs. For example, when the LED 5 is lit, the SW12 and the SW22 are turned ON to apply voltage to allow an electric current flowing in a path: voltage V—>>common line COM2—>>LED5—>>drive line SEG2—>>GND, and the LED 5 is turned on.

Frame

A frame is a unit of an image displayed on a screen of the display apparatus 100, and includes at least one sub-frame. A method of displaying a single frame in multi-gradation with a plurality of sub-frames can be referred to as a sub-frame modulation.

Sub-Frame

A sub-frame is a unit of executing a scan through common lines, in which weighting control is applied to each of the common lines to express multiple gradations.

Display 10

Figure 2:
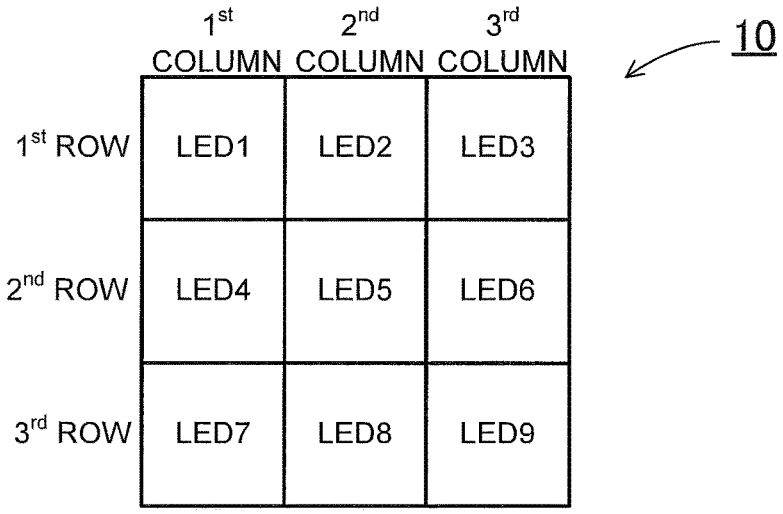
FIG. 2 is a diagram showing an example of a display of the display apparatus according to the first embodiment of the present disclosure.

FIG. 2 shows an example of a display 10 of the display apparatus 100 according to the first embodiment of the present disclosure. As shown in FIG. 2, the display 10 has nine divisions that are arranged in a matrix of three rows and three columns. The plurality of LEDs 1 to 9 are assigned to the nine sections respectively. For example, during the lighting period of the LED 1, the section to which the LED 1 is assigned (e.g., the section at the first row and the first column) is turned on, and during the lighting period of the LED 9, the section to which the LED 9 is assigned (e.g., the section at the third row and the third column) is turned on.

Figure 3:
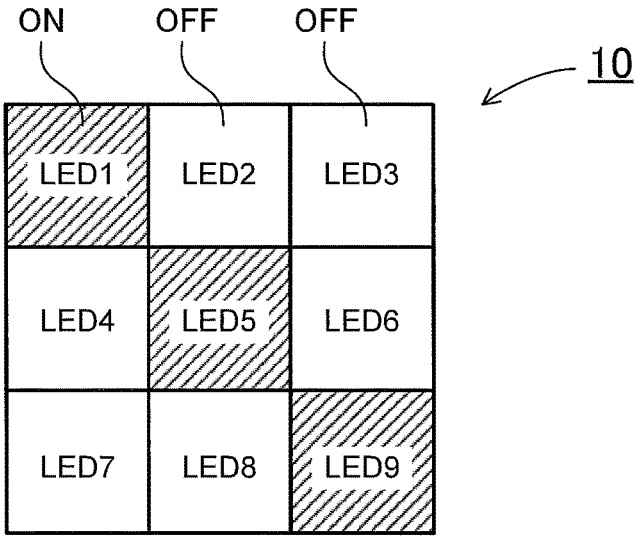
FIG. 3 is a diagram showing an example of a display executed in FIG. 2.

FIG. 3 is a diagram showing an example of a display executed in the display 10. As shown in FIG. 3, the display apparatus 100 according to the first embodiment displays a display shown in FIG. 3 on the display 10 shown in FIG. 2, by operating the plurality of LEDs 1 to 9 to turn ON or turn OFF. In FIG. 3, the sections that are turned ON are indicated with hatched lines.

Next, a reduction in pseudo lighting of a light emitting element will be illustrated with reference to FIG. 3, FIG. 4, and FIG. 5.

Comparative Example

Figure 4:
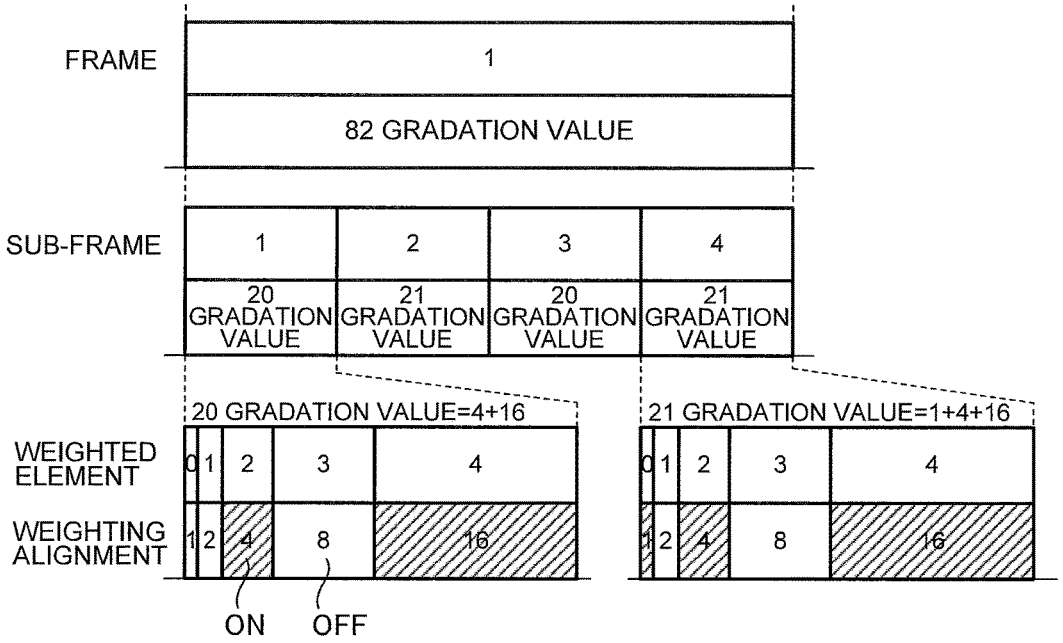
FIG. 4 is a timing chart illustrating a gradation control method according to Comparative Example.

FIG. 4 is a timing chart illustrating a gradation control method according to a Comparative Example. A single display, i.e., a single frame is divided into four sub-frames 1 to 4 in a time-sharing manner. Each sub-frame can express $2^5$=32 gradations so that with the four sub-frames, a single frame can be expressed with a maximum of 32 (gradation value)×4 (sub-frames)=128 gradation value. For example, when a single frame is expressed with 82 gradation value in a display apparatus that can express a single frame with a maximum of 128 gradations, the 82 gradation value is expressed by four sub-frames. In view of the easiness of design or the like, the gradations are allocated to the four sub-frames to obtain as uniform gradation value as possible among the sub-frames, in other words, the gradation value are allocated so that difference in gradation value among the sub-frames becomes small. Since 82 (gradation value)/4=20.5 (gradation value), in the example shown in FIG. 4, the gradations are divided into two 20 gradation value and two 21 gradation value. The value of gradation of 82 in decimal is 1010010 in binary, where the higher five bits (10100) represents the 20 (in decimal) gradations in a single sub-frame and the lower two bits (10) represents 2 (in decimal) that is the number of sub-frames involving the modulation. Thus, 20 gradation value and 21 gradation value are alternately allocated to the sub-frames 1 to 4, to 20 gradation value—>>21 gradation value—>>20 gradation value—>>21 gradation value. Next, allocation of the gradation value to each of the sub-frames (hereinafter may be referred to as "weighting arrangement") will be more specifically described. For each of the sub-frames 1 and 3, 20 gradation value is allocated. As described above, each sub-frame can express 5 bits, that is 32 gradation value. Elements (referred to as "weighted elements") are weighted by power of two and each weighted element is assigned to determine ON or OFF of corresponding one of the light emitting elements. The weighted elements expressed by power of two are arranged in ascending order. In the present Comparative Example, a five bit is employed, so that each sub-frame is designated with five weighted elements of $2^0$=1, $2^1$=2, $2^2$=4, $2^3$=8, and $2^4$=16. In the description below, the weighted elements will be named elements 0 to 4 corresponding to $2^0$ to $2^4$ to distinguish between weighted elements. Then, ON or OFF of corresponding light emitting elements are set to each of the weighted elements 0 to 4.

In the example shown in FIG. 4, the sub-frames 1, and 3 are assigned to 20 gradation value. Thus, as shown in the lower left of FIG. 4, only the weighted element 2 (4 gradation value) and the weighted element 4 (16 gradation value) are set to ON and the rest of the weighted elements 0, 1, and 3 are set to OFF. As described above, the duration of ON is indicated by hatched lines and the duration of OFF is indicated by blank space. Meanwhile, the sub-frames 2, and 4 are assigned to 21 gradation value, so that as shown in the lower right of FIG. 4, only the weighted element 0 (1 gradation value), the weighted element 2 (4 gradation value), and the weighted element 4 (16 gradation value) are set to ON and the rest of the weighted elements 1 and 3 are set to OFF. However, in such an allocation, the weighted element 4 (i.e., 16 gradation value) at the end of each sub-frame period is ON, which may cause a significant degree of pseudo lighting. As used in the present specification, the term "a significant degree of pseudo lighting" refers to an increase in the occurrence of pseudo lighting, more noticeable pseudo lighting, and/or an increase in brightness of pseudo lighting. Meanwhile, the term "decreasing the pseudo lighting" a decrease in the occurrence of pseudo lighting, less noticeable pseudo lighting, and/or a decrease in brightness of pseudo lighting. Occurrence of such a significant degree of pseudo lighting in performing a lighting control in a frame that includes such sub-frames will be described below more specifically with reference to an exemplary display shown in FIG. 3. When the LED1, LED5, and LED9 are turned ON in a single sub-frame, LED1, LED5, and LED9 are turned ON by the common line COM1, COM2, and COM3, respectively. At this time, in the gradation lighting control method according to the Comparative Example, when the LED1 is turned ON by using the common line COM1, the weighted element 4 (i.e., 16 gradation value) in ON, so that the parasitic capacitance between the drive line SEG 1 and GND cannot be charged (or charging-period is too short) through the LED1. As a result, when LED5 is turn on by the subsequent common line COM2, the parasitic capacitance between the drive line SEG1 and GND is charged through LED4 that is not subjected to be turned ON, resulting in substantial degree of pseudo lighting at LED 4. Also, the weighted element 4 (i.e., 16 gradation value) is ON when LED5 is turned ON by using the common line COM 2, so that the parasitic capacitance between the drive line SEG2 and GND is not charged (or charging-period is too short) through LED5. As a result, when LED9 is turn on by the subsequent common line COM3, the parasitic capacitance between the drive line SEG2 and GND is charged through LED8 that is not subjected to be turned ON, resulting in substantial degree of pseudo lighting at LED 8. Further, the weighted element 4 (i.e., 16 gradation value) is ON when LED9 is turned ON by using the common line COM 3, so that the parasitic capacitance between the drive line SEG3 and GND is not charged (or charging-period is too short) through LED9. As a result, when LED1 is turn on by the common line COM1 in another subsequent sub-frame, the parasitic capacitance between the drive line SEG3 and GND is charged through LED5 that is not subjected to be turned ON, resulting in substantial degree of pseudo lighting at LED 3.

On the other hand, in the gradation lighting control method of the display apparatus 100 according to the first embodiment, allocation of gradations to sub-frames is not evenly divided but to reduce the number of sub-frames in which the weighted element at the end of timeline in the weighting alignment is turned ON. That is, providing a period to turn OFF the light emitting element at the end of each sub-frame may allow charging of pseudo lighting element between the drive line and GND reduce the pseudo lighting in the period, and thus a reduction in the pseudo lighting can be expected.

It is preferable that the light emitting element corresponding to the weighted element at the end of weighting alignment is OFF in at least a half number of sub-frames in a single frame. Further, it is preferable that the longer the period of turning OFF the light emitting element corresponding to the weighted element at the end of weighting alignment, the greater effect in reducing pseudo lighting.

Further, as described above, uneven allocation of gradations among the sub-frames is allowed. Different allocation of gradation values between adjacent sub-frames allows to reduce the pseudo lighting. For example, among the sub-frames in a single frame, a difference in the gradation values between adjacent subs-frames can be set 10% or greater with respect to an average gradation value allocated to the sub-frames.

Figure 5:
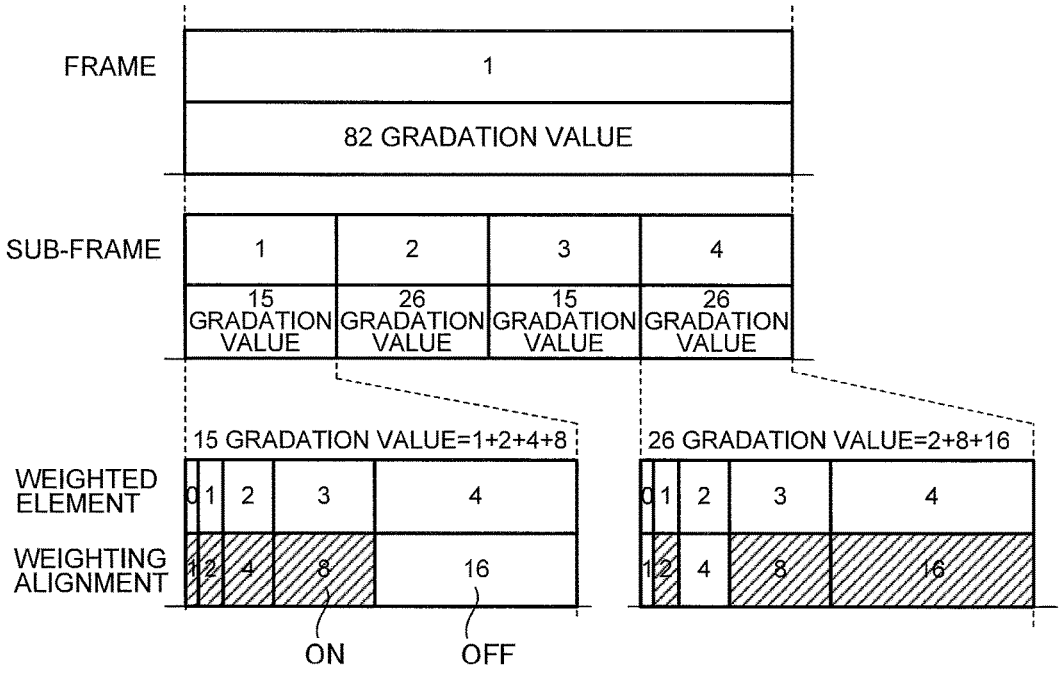
FIG. 5 is a timing chart illustrating a gradation control method according to the first embodiment of the present disclosure.

In the example of the first embodiment shown in FIG. 5, 82 gradation value is allocated to the sub-frames with 15 gradation value×2 and 26 gradation value×2, compared to the example shown in FIG. 4 where 82 gradation value is allocated with 20 gradation value×2 and 26 gradation value×2. That is, compared to the allocation shown in FIG. 4, ±5 gradation values are non-uniformly allocated in FIG. 5. In this example, 15 gradation value is allocated to each of the sub-frames 1 and 3, and 26 gradation value is allocated to each of the sub-frames 2 and 4. Among those, the sub-frames 2 and 4 of 26 gradation value is, as shown in lower right of FIG. 5, set so that the weighted element 1 (2 gradation value), the weighted element 3 (8 gradation value), and the weighted element 4 (16 gradation value) are ON and the rest of the weighted elements 0 and 2 are OFF. Thus, in the sub-frames 2 and 4, the weighted element 4 (16 gradation value) at the end of timeline is ON, so that as similar to the case in Comparative Example shown in FIG. 4, significant degree of pseudo lighting may result. Meanwhile, the sub-frames 1 and 3 of 15 gradation value is, as shown in lower left in FIG. 5, set so that the weighted element 0 (1 gradation value), the weighted element 1 (2 gradation value), the weighted element 2 (4 gradation value), and the weighted element 3 (8 gradation value) are ON and the rest of the weighted element 4 is OFF. Thus, in the sub-frames 1 and 3, the weighted element 4 (16 gradation value) at the end of timeline is OFF, so that different from the case in Comparative Example shown in FIG. 4, the parasitic capacitance between the drive line and GND is charged at the end of timeline of the sub-frames and with such a state, lighting control of the subsequent common line or the subsequent sub-frame is executed. As a result, charging of the parasitic capacitance between the drive line and GND through the LED that is not subjected to be turned ON becomes difficult, so that pseudo lighting can be reduced compared to the case shown in FIG. 4.

In the example described above, gradation values are non-uniformly allocated to the sub-frames with a ±5 increase/decrease of gradation value with respect to those allocated to the sub-frames in Comparative Example, in other words, with a difference in the gradation values set to 11. The increase/decrease of gradation value allocated to the sub-frames can be set with an appropriate value as well as 5 as shown above.

Second Embodiment

Figure 6:
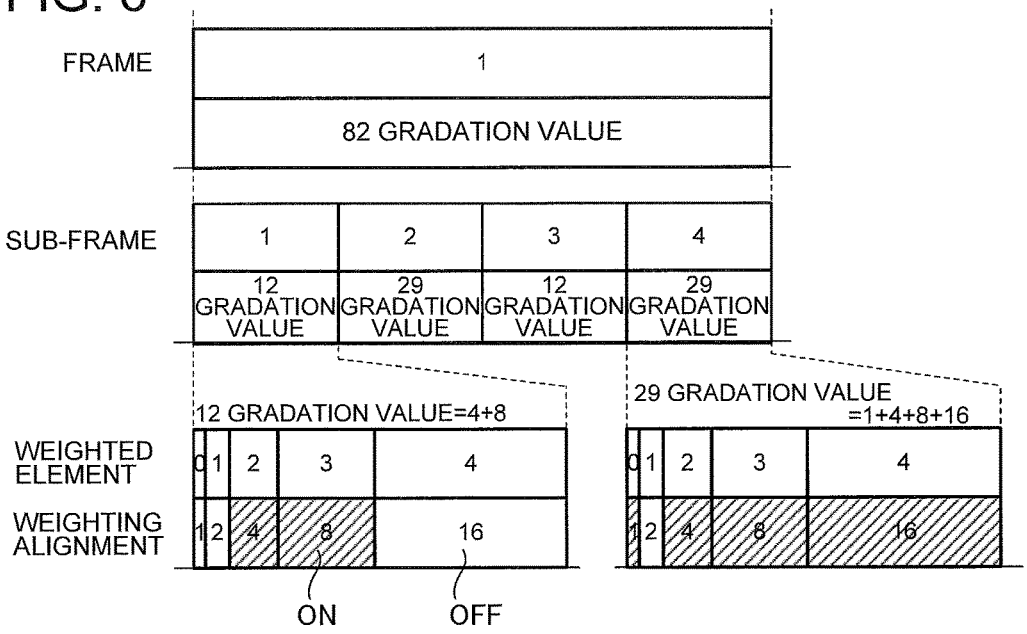
FIG. 6 is a timing chart illustrating a gradation control method according to the second embodiment of the present disclosure.

A second embodiment is configured such that, in comparison to Comparative Example in which gradation values are substantially uniformly allocated in each of the sub-frames, when a maximum gradation value that each sub-frame can express in 2Y−1, gradation values of ±2Y−2 are non-uniformly allocated in each of the sub-frames, as an example shown in FIG. 6. The 82 gradation value is allocated to the sub-frames with 12 gradation value×2 and 29 gradation value×2, while in the example shown in FIG. 4, the 82 gradation value is allocated with 20 gradation value×2 and 21 gradation value×2. That is, with 18 gradation value, a difference in the gradation value is 17 which is larger compared to that in the example shown in FIG. 4. In the example shown in FIG. 6, 12 gradation values are allocated to each of the sub-frames 1 and 3, and 29 gradation values are allocated to each of the sub-frames 2 and 4. Among those, the sub-frames 2 and 4 of 29 gradation values are, as shown in lower right of FIG. 6, set so that the weighted element 0 (1 gradation value), the weighted element 2 (4 gradation value), the weighted element 3 (8 gradation value) and the weighted element 4 (16 gradation value) are ON and the weighted element 1, which is the rest of the weighted elements is OFF. Thus, in the sub-frames 2 and 4, the weighted element 4 (16 gradation value) at the end of timeline is ON, so that as similar to the case in Comparative Example and the first embodiment, significant degree of pseudo lighting may result. Meanwhile, the sub-frames 1 and 3 of 12 gradation values are, as shown in lower left in FIG. 6, set so that the weighted element 2 (4 gradation value) and the weighted element 3 (8 gradation value) are ON and the rest of the weighted elements 0, 1 4 are OFF. Thus, in the sub-frames 1 and 3, the weighted element 4 (16 gradation value) at the end of timeline is OFF, so that as similar to the case in the first embodiment, pseudo lighting can be reduced. As a result, compared to Comparative Example, pseudo lighting can be reduced.

Timing Chart

Figure 7:
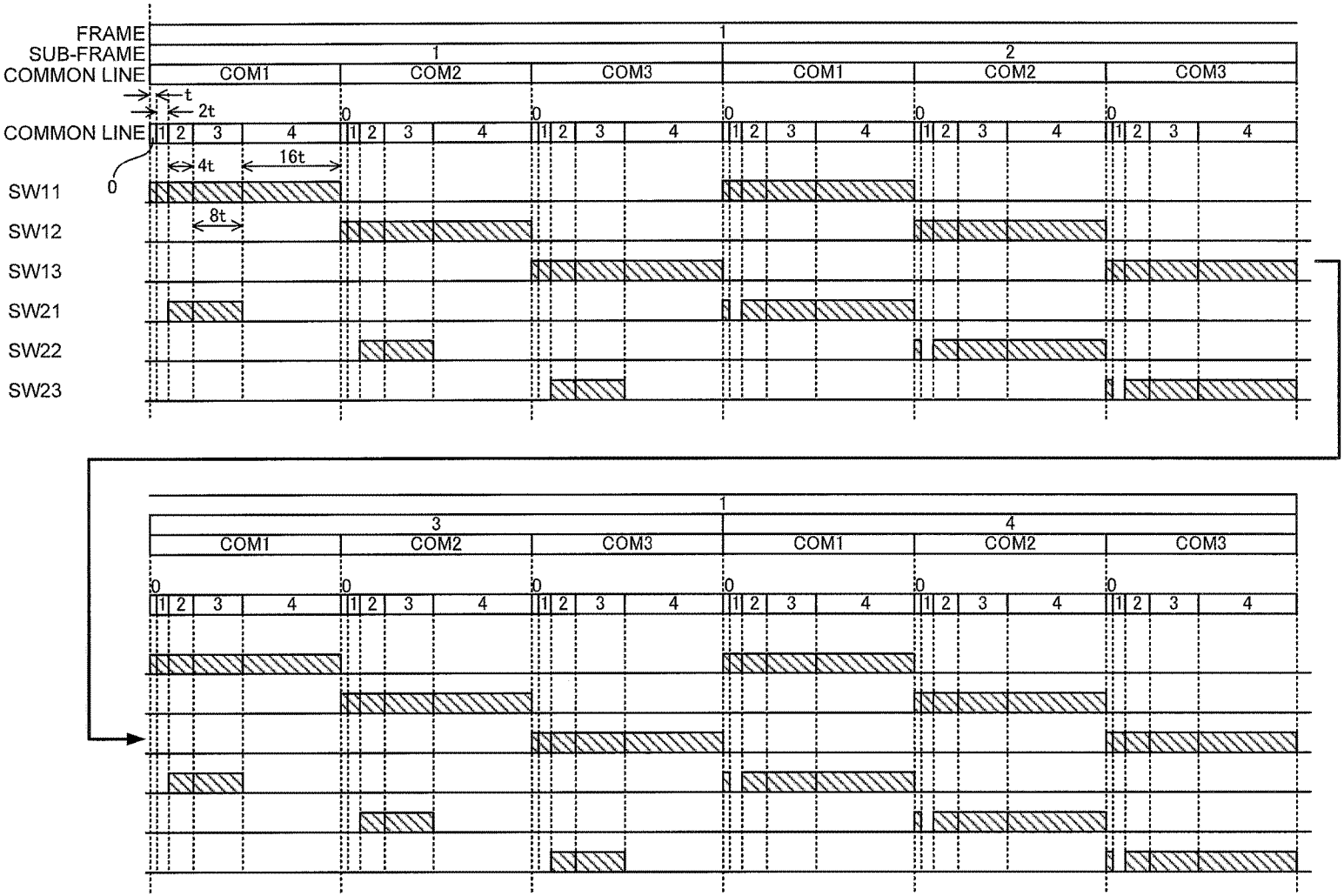
FIG. 7 is a timing chart illustrating a sequence realizing the display shown in FIG. 3 with the gradation control method according to the second embodiment of the present disclosure.

Next, execution of gradation lighting control in the display device according to the second embodiment will be described with reference to the timing chart shown in FIG. 7. In the example shown in FIG. 7, a single frame includes four sub-frames (sub-frames 1 to 4). Each sub-frame scans three common lines (COM1 to COM3). One unit is designated to scanning of a single common line and which is controlled by 5 levels of weighting. Each of the sub-frames are controlled by 5 levels of weighting by powers of two (0:1:2:4:8), so that 32 levels (i.e., $2^5$=32) of gradations can be displayed in a single sub-frame. With the use of sub-frames 1 to 4 in the frame 1, the display shown in FIG. 3 is executed by turning the LEDs 1, 5, 9 corresponding to the pixels from upper left to lower right that are indicated by hatched lines in FIG. 3 are turned on with 12 gradation values or 29 gradation values and all the other pixels are turned on with 0 gradation value.

The 5 levels of weightings are indicated as weighted elements 0 to 4, as such the period of the weighted element 0 is t, the period of the weighted element 1 is 2t, the period of the weighted element 2 is 4t, the period of the weighted element 3 is 8t, and the period of the weighted element 4 is 16t. The LEDs to be lit with 12 gradation values are turned on at the weighted elements 2 and 3, and is turned off at the weighted elements 0, 1, and 4. The LEDs to be lit with 29 gradation values is turned on at the weighted elements 0, 2, and 4, and is turned off at the weighted element 1. The LEDs to be lit with the gradation value 0 is turned off at all the weighted elements 0 to 4.

In the sub-frame 1 of the frame 1, during the scanning period of COM1, SW11 is ON and SW12 and SW13 are OFF. During the scanning period of COM1, SW21 are turned ON at the weighted elements 2 and 3, turned OFF at the weighted elements 0, 1, and 4, and SW22 and SW23 are turned OFF at all the weighted elements 0 to 4, thus LED1 is turned ON with 12 gradations and LED2 and LED3 are turned OFF with 0 gradation value.

Similarly, during the scanning period of COM2, SW12 is ON and SW11 and SW13 are OFF. During the scanning period of COM1, SW22 are turned ON at the weighted elements 2 and 3, turned OFF at the weighted elements 0, 1, and 4, and SW22 and SW23 are turned OFF at all the weighted elements 0 to 4, thus LED1 is turned ON with 12 gradation value and LED2 and LED3 are turned OFF with 0 gradation value.

Similarly, during the scanning period of COM3, SW13 is ON and SW11 and SW12 are OFF. During the scanning period of COM1, SW23 are turned ON at the weighted elements 2 and 3, turned OFF at the weighted elements 0, 1, and 4, and SW22 and SW23 are turned OFF at all the weighted elements 0 to 4, thus LED1 is turned ON with 12 gradation value and LED2 and LED3 are turned OFF with 0 gradation value.

In the sub-frame 1 of the frame 2, during the scanning period of COM1, SW11 is ON and SW12 and SW13 are OFF. During the scanning period of COM4, SW21 are turned ON at the weighted elements 0 and 2, turned OFF at the weighted elements 0, 1, and 4, and SW22 and SW23 are turned OFF at all the weighted elements 0 to 4, thus LED1 is turned ON with 29 gradation value and LED2 and LED3 are turned OFF with 0 gradation value.

Similarly, during the scanning period of COM2, SW12 is ON and SW11 and SW13 are OFF. During the scanning period of COM4, SW22 are turned ON at the weighted elements 0 and 2, turned OFF at the weighted elements 0, 1, and 4, and SW22 and SW23 are turned OFF at all the weighted elements 0 to 4, thus LED1 is turned ON with 29 gradation value and LED 2 and LED3 are turned OFF with 0 gradation value.

Similarly, during the scanning period of COM3, SW13 is ON and SW11 and SW12 are OFF. During the scanning period of COM4, SW23 are turned ON at the weighted elements 0 and 2, turned OFF at the weighted elements 0, 1, and 4, and SW22 and SW23 are turned OFF at all the weighted elements 0 to 4, thus LED1 is turned ON with 29 gradation value and LED2 and LED3 are turned OFF with 0 gradation value.

The lighting control of the sub-frame 3 is similar to that of the sub-frame 1 and the sub-frame 4 is similar to that of the sub-frame 2, so that repetitive description will be appropriately omitted. As described above, in a single frame having four sub-frames, lighting with 82 gradation value can be executed in each pixel of LEDs 1, 5, and 9.

The gradation allocations to the sub-frames as described above is preferably predetermined for each gradation values corresponding to the number of the sub-frames or the like. For example, corresponding relations between the indicated gradation values and respective corresponding gradation values allocated to the sub-frames 1 to 4 are held as data to create a look-up table or the like and stored in the setting storage 54 shown in the functional block diagram in FIG. 8 in advance and is referred by the lighting controller 50. Thus, when the gradation value is specified, allocation of gradation values to the sub-frames is uniquely executed, and by the lighting controller 50, lighting control is performed according to the gradations allocated to each of the sub-frames. Alternatively, for example, the gradation values allocated to each of the sub-frames corresponding to the specified gradation values may not be fixed but may be set variably. For example, the lighting controller 50' shown in FIG. 9 controls the gradation values allocated to the sub-frames based on the specified gradation value. The lighting controller 50' determines the gradation values to allocate to each of the sub-frames based on the number of the sub-frames, the gradation value to be displayed, or the like, corresponding to the specified gradation value. The lighting controller 50' shown in FIG. 9 includes an input unit 51', a lighting control data generator 52', a gradation allocator 53', and an output unit 55'. Those components exert functions basically similar to those exerted by the components shown in FIG. 8, so that detailed description will be appropriately omitted.

In the examples illustrated above, when two gradation numbers are allocated to the sub-frames, the gradations of odd-numbered sub-frames are smaller than the gradation of even-numbered sub-frames, but the gradations of odd-numbered sub-frames may be greater than the gradation of even-numbered sub-frames.

Example 1

Next, a display apparatus according to Example 1 will be described below.

In the display apparatus according to Example 1, 1728 LEDs (including three colors of light emitting elements; Red, Green, and Blue) were arranged in rows and columns at intervals of 4 mm. Further, 24 common lines connected to anodes of the LEDs were disposed in the lateral direction, while 216 lines (72 lines×3 colors) of drive lines connected to cathodes of the LEDs were disposed in the longitudinal direction.

A DC 5V constant voltage source was employed as the power supply. A FPGA was employed as the lighting controller 50 that time-divisionally applies voltage to the common lines. A P-channel FET was employed as the source driver, and an NPN transistor driven by a constant-current set to about 18 mA was employed as the sink driver. For the lighting controller 50 that turns ON and OFF the switches and changes sequence in the weighting alignments, a field programmable gate array (FPGA), a microcomputer, or a combination of those can be employed.

The display apparatus according to Example 1 was dynamically driven at a duty ratio of 1/24. The period of applying voltage to a single common line was 47.9 μs, and the period when no voltage is applied to any common lines was 10 μs. At this time, the sub-frame cycle is (47.9 μs+10 μs)×24 rows=1.39 ms.

Thus, 32 sub-frames were set at a cycle of 16.7 ms (60 Hz) that is common for video signals. A single sub-frame was subjected to a 6 levels weighted control by powers of two, and at t=729.2 ns, a sequence of t—>>2t—>>4t—>>8t—>>16t—>>32t was employed. With the use of 32 sub-frames and the 6 levels weighted control, a total of 2048 gradation value (26×32=2048) can be expressed.

In order to facilitate study of the effects, 1728 LEDs are arranged in a matrix of 24 rows×72 columns, and from upper left to lower right in the matrix, each unit of LEDs of 24 rows×24 columns were turned on to exhibit a diagonal lighting with 1024 gradation value, and the background, which was expressed by the other LEDs that were turned off with 0 gradation value.

The lighting was expressed by sub-frame modulation, in which among the sub-frames 1 to 32, the odd-numbered sub-frames were set with 48 gradation value in the diagonal line and 0 gradation value in the background, and the even-numbered sub-frames were set with 16 gradation value in the diagonal line and 0 gradation value in the background.

Visual inspection in a darkroom indicated that pseudo lighting was reduced in the display apparatus described above that in the display apparatus of Comparative Example 1 to be described below. Accordingly, the display apparatus according to Example 1 can be evaluated as a display apparatus with high display quality.

Comparative Example 1

Next, a display apparatus according to Comparative Example 1 will be discussed. A display apparatus according to Comparative Example 1 has basically the same configuration as the display apparatus according to Example 1, but in a sub-frame modulation of the sub-frames 1 to 32, all the sub-frames were set with 32 gradations in the diagonal line and 0 gradation value in the background.

Visual inspection in a darkroom indicated that pseudo lighting was more significant in the display apparatus of Comparative Example 1 than that in the display apparatus of Example 1. Accordingly, the display apparatus according to Comparative Example 1 can be evaluated as a display apparatus with poor display quality.

Certain embodiments have been described above, but the scope of the invention is not limited to the above description, and should be widely understood based on the scope of claim for patent.

The display device according to the present invention can be utilized, for example, in a large screen television as well as a message board displaying information such as traffic updates.

Obviously, numerous modifications and variations of the present invention are possible in light of the above teachings. It is therefore to be understood that within the scope of the appended claims, the invention may be practiced otherwise than as specifically described herein.

What is claimed is:

1. A display apparatus comprising:

a plurality of common lines;

a plurality of drive lines;

a plurality of light emitting elements respectively electrically connected to one of the plurality of common lines and one of the plurality of drive lines;

a scanner to time-divisionally apply a voltage on the plurality of common lines;

a driver to draw electric current at a predetermined timing from drive lines, of the plurality of drive lines, electrically connected to respective light emitting elements, of the plurality of light emitting elements, to turn ON the respective light emitting elements; and a lighting controller to vary lighting periods of the plurality of light emitting elements to express lighting amounts as different gradation values, wherein a single frame is divided into a plurality of sub-frames and a gradation value to express in the single frame is divided into gradation values and allocated to the plurality of sub-frames, the gradation values allocated to the sub-frames are time-divisionally expressed so that the gradation value of the single frame is expressed by a total of the gradation values of the sub-frames, wherein each of the plurality of sub-frames includes a plurality of weighted elements with different gradation values to express the gradation values by powers of two, and a weighted element at an end of a timeline of a single sub-frame is assigned with a maximum gradation value, and wherein, provided that the single frame includes X sub-frames, where X is an integer greater than 1, a maximum gradation value that is expressed by each of the sub-frames is $2^Y-1$, where Y is an integer greater than 1, and the single frame is expressed by the gradation value in a range of $X \cdot 2^{Y-1}$ to $X(2^Y-1)-2^{Y-1}$, the lighting controller allocates the gradation value to each of the sub-frames so that the weighted element at the end of the timeline of at least one sub-frame of the plurality of sub-frames in the single frame is turned OFF.

2. The display apparatus according to claim 1, wherein, among the plurality of sub-frames in the single frame, a light emitting element corresponding to the weighted element at the end of the timeline of the single sub-frame is turned OFF at a half or greater number of sub-frames.

3. The display apparatus according to claim 1, wherein the lighting controller is configured to allocate the gradation value to each of the sub-frames so that a difference between the maximum gradation value and a minimum gradation value in each of the sub-frames is two or greater.

4. The display apparatus according to claim 2, wherein the lighting controller is configured to allocate the gradation value to each of the sub-frames so that a difference between the maximum gradation value and a minimum gradation value in each of the sub-frames is two or greater.

5. The display apparatus according to claim 1, wherein, among the plurality of sub-frames in the single frame, a difference of gradation values between adjacent sub-frames is $2^{Y-1}+1$.

6. The display apparatus according to claim 2, wherein among the plurality of sub-frames in the single frame, a difference of gradation values between adjacent sub-frames is $2^{Y-1}+1$.

7. The display apparatus according to claim 3, wherein, among the plurality of sub-frames in the single frame, a difference of gradation values between adjacent sub-frames is $2^{Y-1}+1$.

8. The display apparatus according to claim 4, wherein, among the plurality of sub-frames in the single frame, a difference of gradation values between adjacent sub-frames is $2^{Y-1}+1$.

9. The display apparatus according to claim 1, wherein, in the plurality of sub-frames, the weighted elements in each sub-frame are aligned to increase the gradation value along the timeline.

10. The display apparatus according to claim 2, wherein, in the plurality of sub-frames, the weighted elements in each sub-frame are aligned to increase the gradation value along the timeline.

11. The display apparatus according to claim 3, wherein, in the plurality of sub-frames, the weighted elements in each sub-frame are aligned to increase the gradation value along the timeline.

12. The display apparatus according to claim 4, wherein, in the plurality of sub-frames, the weighted elements in each sub-frame are aligned to increase the gradation value along the timeline.

* * * * *